US006237366B1

(12) United States Patent
Arman et al.

(10) Patent No.: US 6,237,366 B1
(45) Date of Patent: May 29, 2001

(54) CRYOGENIC AIR SEPARATION SYSTEM USING AN INTEGRATED CORE

(75) Inventors: Bayram Arman, Grand Island, NY (US); Tu Cam Nguyen, Falcon Heights, MN (US); Dante Patrick Bonaquist, Grand Island; Kenneth Kai Wong, Amherst, both of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/550,392

(22) Filed: Apr. 14, 2000

(51) Int. Cl.[7] ..... F25J 3/00
(52) U.S. Cl. ..... 62/643; 62/903
(58) Field of Search ..... 62/643, 646, 903, 62/644

(56) References Cited

U.S. PATENT DOCUMENTS

| | | | | |
|---|---|---|---|---|
| 2,861,432 | * | 11/1958 | Haselden | 62/643 |
| 5,144,809 | | 9/1992 | Chevalier et al. | 62/36 |
| 5,207,065 | * | 5/1993 | Lavin et al. | 62/903 |
| 5,275,004 | | 1/1994 | Agrawal et al. | 62/24 |
| 5,410,885 | | 5/1995 | Smolarek et al. | 62/25 |
| 5,461,870 | * | 10/1995 | Paradowski | 62/903 |
| 5,463,871 | | 11/1995 | Cheung | 62/38 |
| 5,592,832 | | 1/1997 | Herron et al. | 62/646 |
| 5,596,883 | | 1/1997 | Bernhard et al. | 62/618 |
| 5,694,790 | | 12/1997 | Lavin | 62/640 |
| 5,699,671 | | 12/1997 | Lockett et al. | 62/63 |
| 5,724,834 | | 3/1998 | Srinivasan et al. | 62/643 |

* cited by examiner

*Primary Examiner*—William Doerrler
(74) *Attorney, Agent, or Firm*—Stanley Ktorides

(57) ABSTRACT

A cryogenic air separation system wherein an integrated core receives and cools an incoming feed air stream, a rectification section facilitates mass transfer of the feed air stream, a separation section in a heat exchange relationship with the rectification section processes fluid from the rectification section, and a section in a heat exchange relationship with an entrance passage discharges fluid from the integrated core.

10 Claims, 8 Drawing Sheets

CRYOGENIC AIR SEPARATION SYSTEM USING AN INTEGRATED CORE

FIELD OF THE INVENTION

This invention generally relates to an integrated heat exchange core that includes sections for various levels of heat transfer and mass transfer, in order to enhance thermodynamic efficiency and to reduce capital costs in cryogenic air separation systems.

BACKGROUND OF THE INVENTION

Cryogenic air separation systems are known in the art for separating gas mixtures into heavy components and light components, typically oxygen and nitrogen, respectively. The separation process takes place in plants that cool incoming mixed gas streams through heat exchange with other streams (either directly or indirectly) before separating the different components of the mixed gas through mass transfer methods such as rectification, stripping, reflux condensation (dephlegmation), and reboiling. Once separated, the different component streams must then be warmed back to ambient temperature through heat transfer components. Typically, the different warming, cooling and separation steps take place in separate structures, each of which adds to the manufacturing costs.

It is generally desired in the art to improve air separation devices by increasing their efficiency and/or reducing capital costs of the systems. Various air separation systems have been introduced that combine what were traditionally separate structures in order to provide an integrated device. In particular, different heat exchangers for warming or cooling fluid streams, and separation devices for separating out heavy and light components in the streams, may be partially combined in a single heat exchange core to reduce the number of structures needed in an air separation plant.

However, none of the known systems provides a suitable design for fully integrating a number of heat transfer functions with separation systems for simultaneous heat and mass transfer.

SUMMARY OF THE INVENTION

The present invention is directed to an air separation system with a unique integration design that provides a single brazed core that can combine separation networks with a host of heat exchange functions.

The present invention provides the opportunity to increase the core size because of the increased number of streams and operations to be carried out. This allows for improved economy because of core size. Proper distribution of flows permits optimizing the utilization of heat transfer area. Use of proper velocities for two phase flows also prevents problems such as flooding.

Generally speaking, the present invention relates to an air separation system utilizing an integrated core that provides simultaneous heat and mass transfer. Preferably, the integrated core is a brazed plate-fin core made of aluminum. The integrated core may include a plurality of passages arranged so as to effectively combine a number of levels of heat transfer (such as cooling a feed air stream down to cryogenic temperatures, subcooling/superheating process streams, and boiling liquid streams), as well different types of mass transfer (such as rectification and stripping).

In a preferred design of the integrated core, a set of entrance passages (although only one passage for each different function or stream of the core is necessary) receives an incoming feed air stream and cools the incoming feed air stream against exiting streams in other passages. A rectification section, including at least one passage for receiving the feed air stream, provides mass transfer of the feed air stream to produce a first liquid stream, enriched in a heavy component (typically oxygen), and a first vapor stream, enriched in a light component (typically nitrogen). A first set of exit passages, in a heat exchange relationship with the entrance passages, receives the first vapor stream and discharges the first vapor stream, while warming it, from the integrated core.

A separation section is provided and includes at least one passage in a heat exchange relationship with the passages of the rectification section. The separation section receives the first liquid stream and further separates the first liquid stream into a second liquid stream and a second vapor stream. Preferably, the separation section is a stripping column that provides mass transfer by stripping (using countercurrent flow) the first liquid stream. However, in other embodiments, other separation systems may be used. In particular, the separation section may boil the first liquid stream to separate it into liquid and gas phases.

The integrated core may also include another set of exit passages, in a heat exchange relationship with the entrance passages. The other exit passages receive the second vapor stream and discharge it from the integrated core as it is warmed. A set of vaporization passages, preferably in a heat exchange relationship with the entrance passages, receives and vaporizes the second liquid stream, and then discharges the vaporized second liquid stream from the integrated core.

Typically, the integrated core is designed so that the entrance and exit passages are at the same end of the core. In this type of design, the feed air stream enters the entrance passages in an upward direction of flow, and the passages discharging the process streams are orientated so as to discharge their streams in a downward direction of flow. In such an arrangement, the separation sections are located at the other end of the integrated core, above the openings for receiving and discharging air streams. The end including the separation systems generally is the cooler end of the integrated core. This design, however, may be reversed such that the air streams are received and discharged from a top end of the integrated core and the separation sections are located in a bottom end of the integrated core.

In another embodiment of the present invention, a double column separation device may be used in conjunction with the integrated core to provide additional separation. In such a device, the integrated core may be modified to discharge streams to and receive streams from the higher pressure column and lower pressure column of the double column separation device. The double column separation device may operate similarly to conventional double column systems, with the columns being in flow communication with each other. In the present invention, all of the feed streams for the double column system may be provided from the integrated core. Similarly, the integrated core may receive all of the waste and product streams from the double column system for further processing.

The numerals in the Figures are the same for the common elements.

DETAILED DESCRIPTION OF THE PREFERRED EMBODIMENTS

Figure 1:
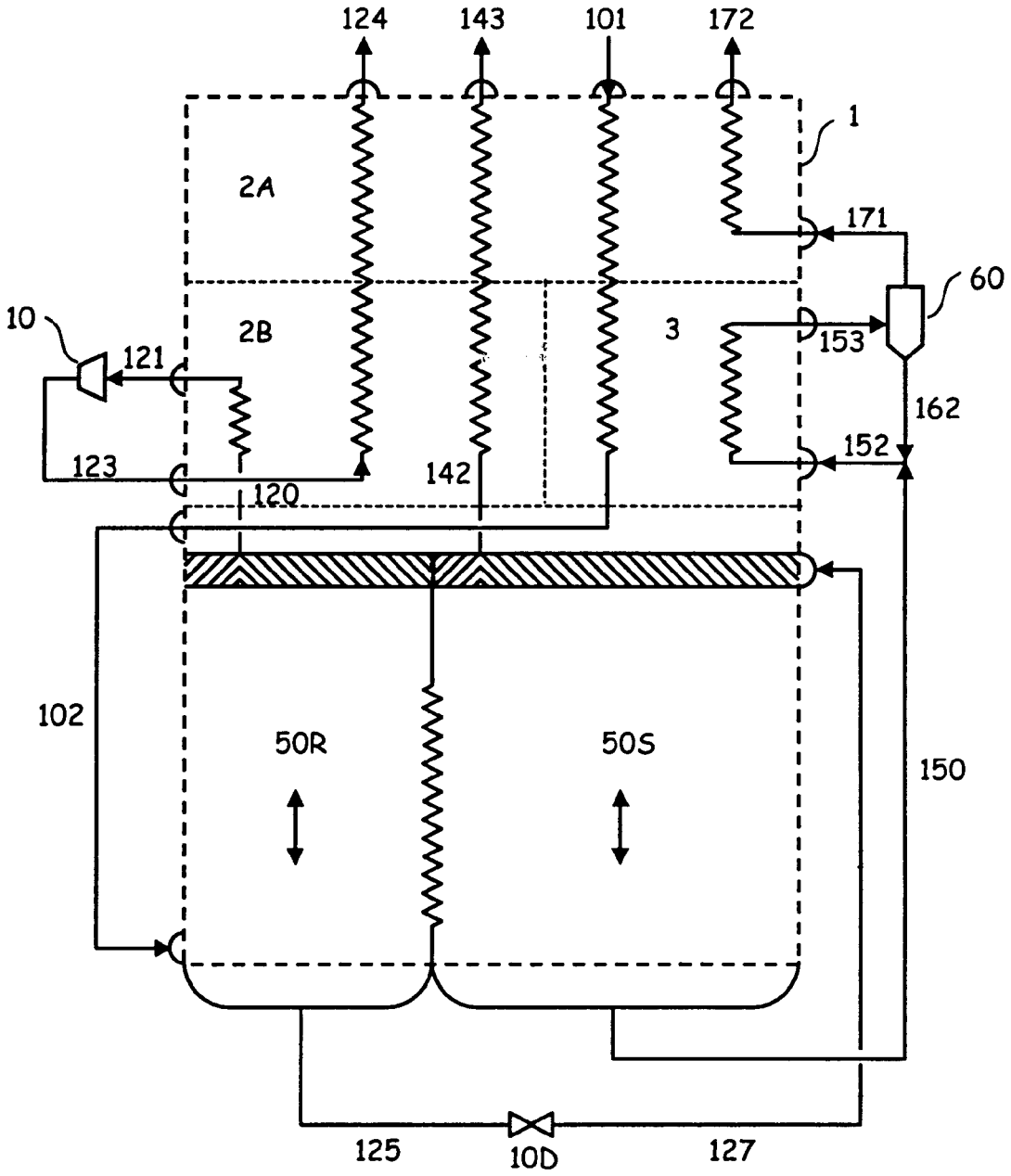
FIG. 1 shows an integrated heat exchange core of the first embodiment of the present invention, which includes a reflux condenser embedded in the integrated core, with both condensing and boiling side separation.

FIG. 1 shows a preferred embodiment of the present invention. As shown, the invention may be embodied by a cryogenic air separation apparatus that includes a brazed, integrated heat exchange core with a reflux condenser embedded therein. The depicted integrated core utilizes both condensing and boiling-side separation. This apparatus is typically used to produce a low purity gas, usually about 38 to about 70% $O_2$ and/or about 95 to about 99% $N_2$.

In the apparatus of this embodiment, an incoming pre-purified, low pressure feed air stream 101 may be cooled against exiting stream 142 (typically a light component waste product, such as nitrogen in this case), stream 123 (typically a light component product stream, such as nitrogen in this case), and stream 171 (typically a heavy component product stream, such as oxygen in this case) to a temperature of about 90–105K. Preferably, this occurs along heat transfer section 2A, which is at a warmer end of integrated core 1.

To facilitate heat transfer among the various air streams, heat transfer sections 2A and 2B may include a plate-fin design, wherein passages have corrugated inserts that allow fluid streams to flow through integrated core 1 in heat exchange relationships with fluid streams in other passages. We prefer that the plate-fin system be constructed with aluminum walls and corrugations to facilitate heat transfer and to keep costs low. This type of heat exchange design may also be incorporated in other sections of integrated core 1 wherever heat exchange relationships are utilized. Preferably, each of the heat exchange systems of integrated core 1 are of the plate-fin design and are incorporated in a single brazed aluminum core. It should be understood, however, that the design of integrated core 1 may be varied to accommodate other heat transfer designs.

In heat transfer section 3 of integrated core 1, air stream 101 may be partially condensed (in a heat exchange relationship) against cold product stream 152/153 through one or more passages in integrated core 1. The resulting partially condensed air stream 102 is fed into rectification section 50R.

Rectification section 50R may be comprised of one or more passages designed for simultaneous heat and mass transfer. With respect to mass transfer, rectification section 50R preferably functions as a non-adiabatic rectification column. With respect to heat transfer, rectification section 50R preferably is in a heat exchange relationship with one or more other passages in integrated core 1 with stripping section 50S. The configuration of the passages of rectification section 50R may be varied, while still achieving adequate mass and heat transfer functions. In particular, rectification section 50R may be formed using one or more of plate-fin, packed, or trayed columns, for example.

In the apparatus of FIG. 1, section 50R produces overhead stream 120, which is typically a gas stream enriched in a light component and depleted in a heavy component (normally nitrogen and oxygen, respectively, with a light component purity of about 90% and 99.99%). Overhead stream 120 may be taken out of section 50R as a waste product, or used as a light component product (nitrogen in this case). Overhead stream 120 may be indirectly heated against feed air stream 101 through passages along the length of heat transfer section 2B of integrated core 1 (preferably to a temperature of about 85 to 95K). In this embodiment, overhead stream 120 exits core 1 as stream 121, where it may be expanded in turboexpander 10 to form expanded stream 123. Expanded stream 123 ultimately is used to provide plant refrigeration. Expanded stream 123, typically product nitrogen, is returned to core 1 where it may be warmed to ambient temperature against incoming feed air stream 101 in heat transfer sections 2A and 2B.

Stream 125 (typically a liquid stream enriched in a heavy component, such as oxygen in this case) exits the bottom of rectification section 50R. Typically, stream 125, when it exits rectification section 50R, includes about 30 to about 60% of the vapor flow at the warmer end of rectification section 50R. Stream 125 may be throttled in valve 10D to form throttled liquid stream 127, which is fed into stripping section 50S.

Stripping section 50S preferably includes one or more passages modified for simultaneous heat and mass transfer, so as to function as a non-adiabatic stripping column. As regards mass transfer, stripping section 50S preferably includes a design that allows cross-flow of liquid and gas components, e.g., a packed or trayed column. As regards heat transfer, stripping section 50S may be in a heat exchange relationship with one or more passages of integrated core 1. In the embodiment depicted in FIG. 1, stripping section 50S is thermally linked in a heat exchange relationship to rectification section 50R. It should be understood, however, that other designs may be incorporated to allow simultaneous heat and mass transfer.

Stripping section 50S may further enrich throttled liquid stream 127 in a heavy component (preferably having a purity of about 43 to 95% oxygen). Stream 142 (typically a gas with a light component purity of about 65 to 98% nitrogen) exits from the top of stripping section 50S and may be warmed to ambient temperature against feed air stream 101 in heat transfer sections 2B and 2A of integrated core 1. Warmed vapor stream 142 exits core 1 as stream 143. Stream 150 (typically a liquid) exits the bottom of stripping section 50S and is combined with liquid stream 162 from the bottom of separator 60 to form liquid stream 152. Stream 152 is then partially vaporized against feed air stream 101 in heat transfer section 3. The resulting vapor-liquid stream 153 is then separated in separator 60, the liquid portion being removed as stream 162. The recirculation of liquid stream 162 is always maintained so as to prevent stream 152 from boiling to dryness.

Because of safety reasons stream 152–153 should not be allowed to be completely vaporized, liquid stream 152 should exit the warm end of section 3 of core 1 as partially vaporized stream 153 to be fed into phase separator 60. In this embodiment, phase separator 60 separates partially vaporized stream 153 into exiting vapor stream 171 and exiting liquid stream 162, which are typically just liquid and vapor phases of the heavy component-enriched stream 153.

After exiting phase separator 60, vapor stream 171 enters integrated core 1 at section 2A. Stream 171 then may be warmed along one or more passages to ambient temperature against incoming feed air stream 101. Liquid stream 162 is re-mixed with stream 150 after exiting phase separator 60 to form mixed stream 152. The mixed stream 152 then may be recirculated to the cold end of section 3 of integrated core 1, again partially vaporized against incoming feed air stream 101, and returned to phase separator 60 as stream 153.

Figure 2:
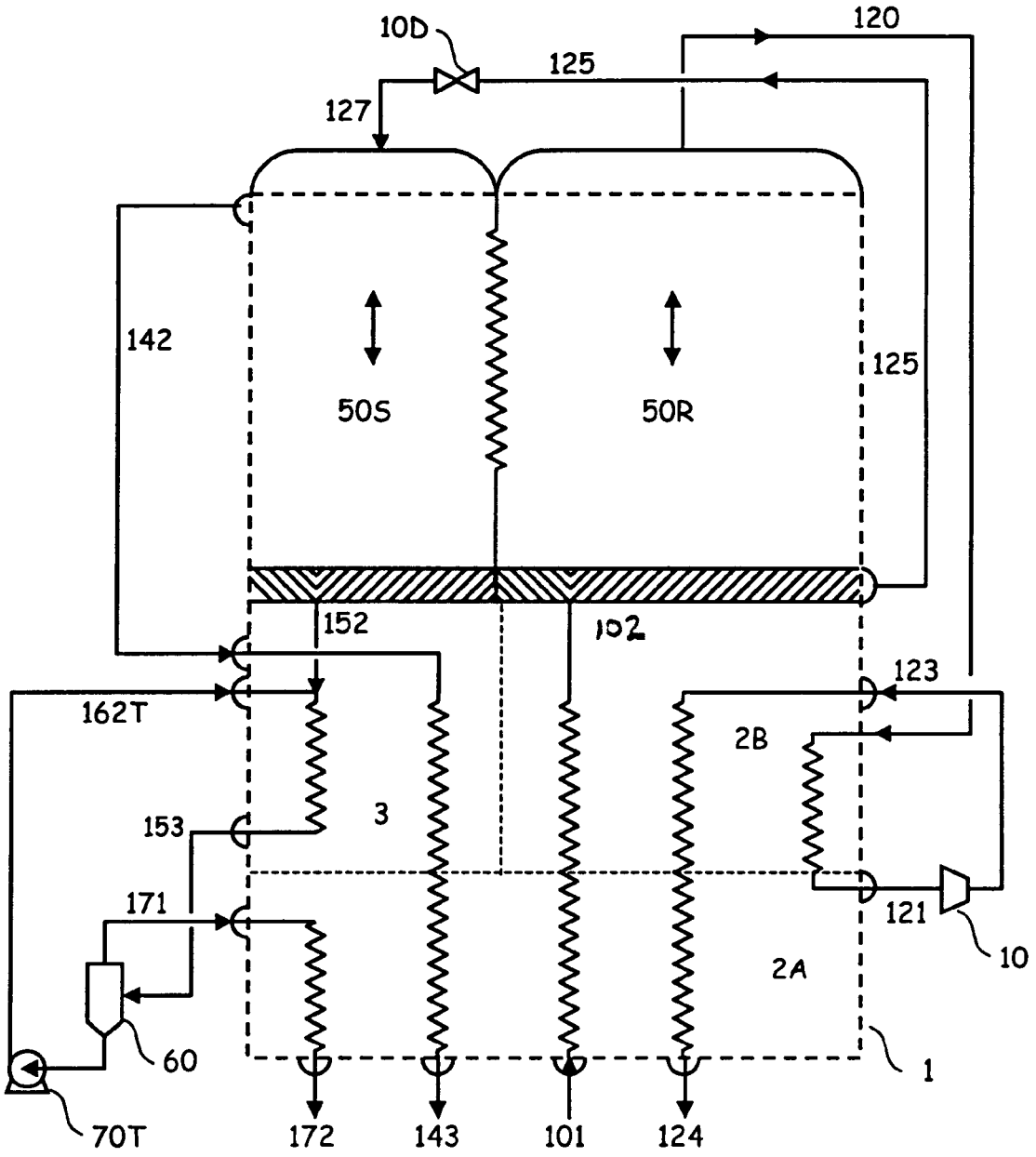
FIG. 2 shows an integrated core similar to that shown in FIG. 1, but with a reverse orientation.

FIG. 2 shows a variation of the apparatus shown in FIG. 1. The cryogenic air separation system of FIG. 2 is similar to FIG. 1, except that the orientation of integrated core 1 is reversed so that incoming air stream 101 is fed into integrated core 1 in an upward direction and outgoing streams 124, 143 and 172 are discharged in a downward direction. In addition, the separation portions (rectification section 50R and stripping section 50S) are positioned above the primary heat exchange sections (sections 2A, 2B and 3). However, the orientation of the individual rectification section 50R and striping section 50S is retained, that is, these sections are not inverted but just moved to the end of core 1. Cold feed stream 102 still enters at the bottom of rectification section 50R, and feed stream 127 still enters stripping section 50S at the top. Inverting the orientation of integrated core 1 can help to improve the thermal interaction between the various streams, depending on the particular plant design.

The apparatus of this embodiment may additionally include pump 70T for pumping liquid stream 162T from phase separator 60 back into section 3 of the integrated core 1, thus accounting for gravity effects inherent in reversing the orientation of the cryogenic air separation apparatus. The remainder of the features of this embodiment are similar to those described with respect to FIG. 1 and, therefore, will not be repeated herein.

Figure 3:
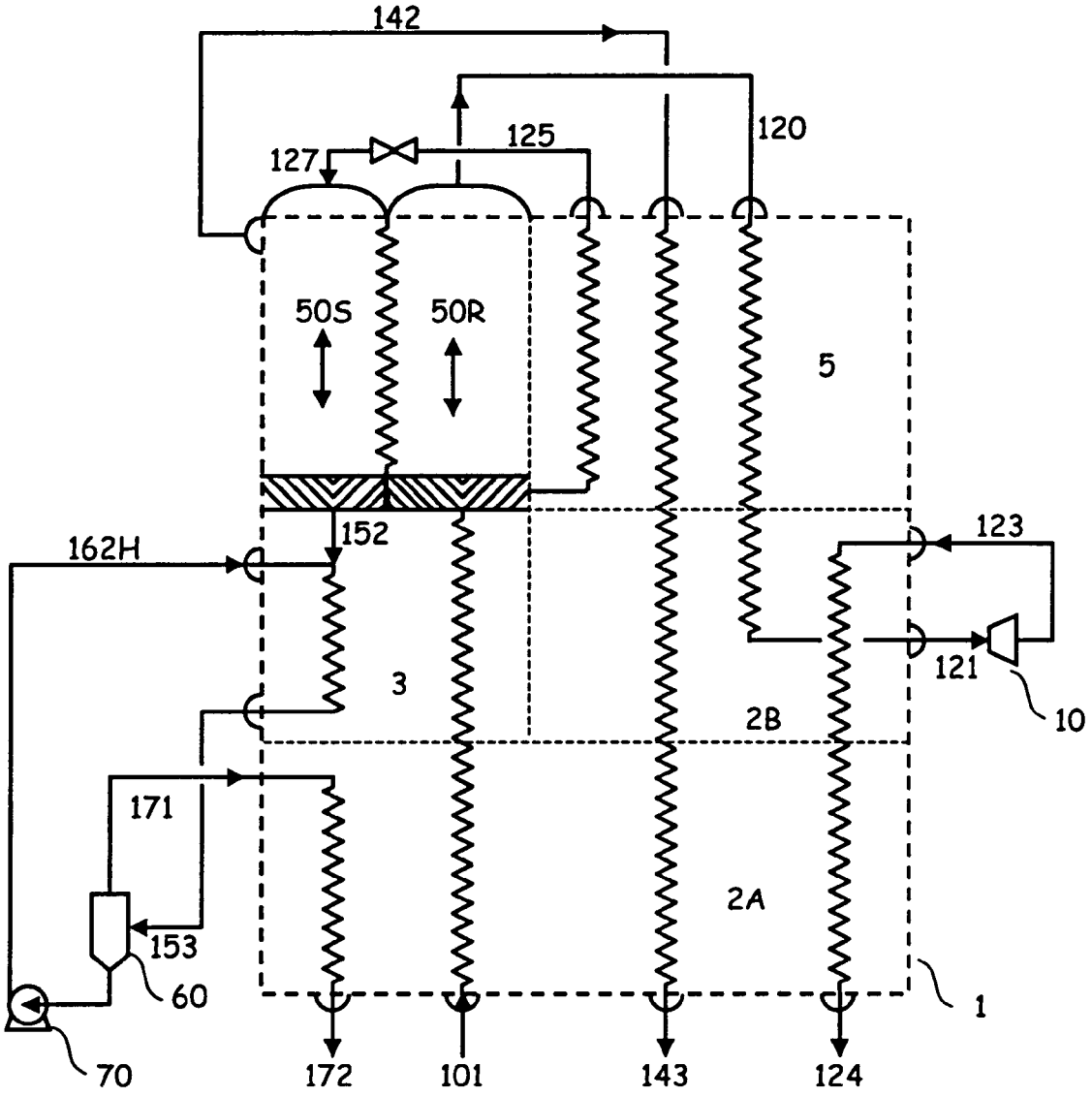
FIG. 3 shows an integrated core similar to that shown in FIG. 2, but with a superheating zone.

FIG. 3 depicts another embodiment of the present invention. The cryogenic air separation apparatus shown in FIG. 3 is similar to the apparatus shown in FIG. 2, but additionally includes heat transfer zone 5 at the cooler end of integrated core 1.

Heat transfer zone 5 may be used for subcooling stream 125 (heavy component-rich liquid) from rectification section 5OR against stream 142 (typically light component-rich waste product) from stripping section 50S (typically to a temperature of about 79 to 90K). Liquid stream 125 also may be subcooled, in heat transfer zone 5, against stream 120 (typically light component-rich vapor) exiting the rectification section 50R. The remainder of the features of this apparatus are similar to those already described with respect to FIGS. 1 and 2.

Figure 4:
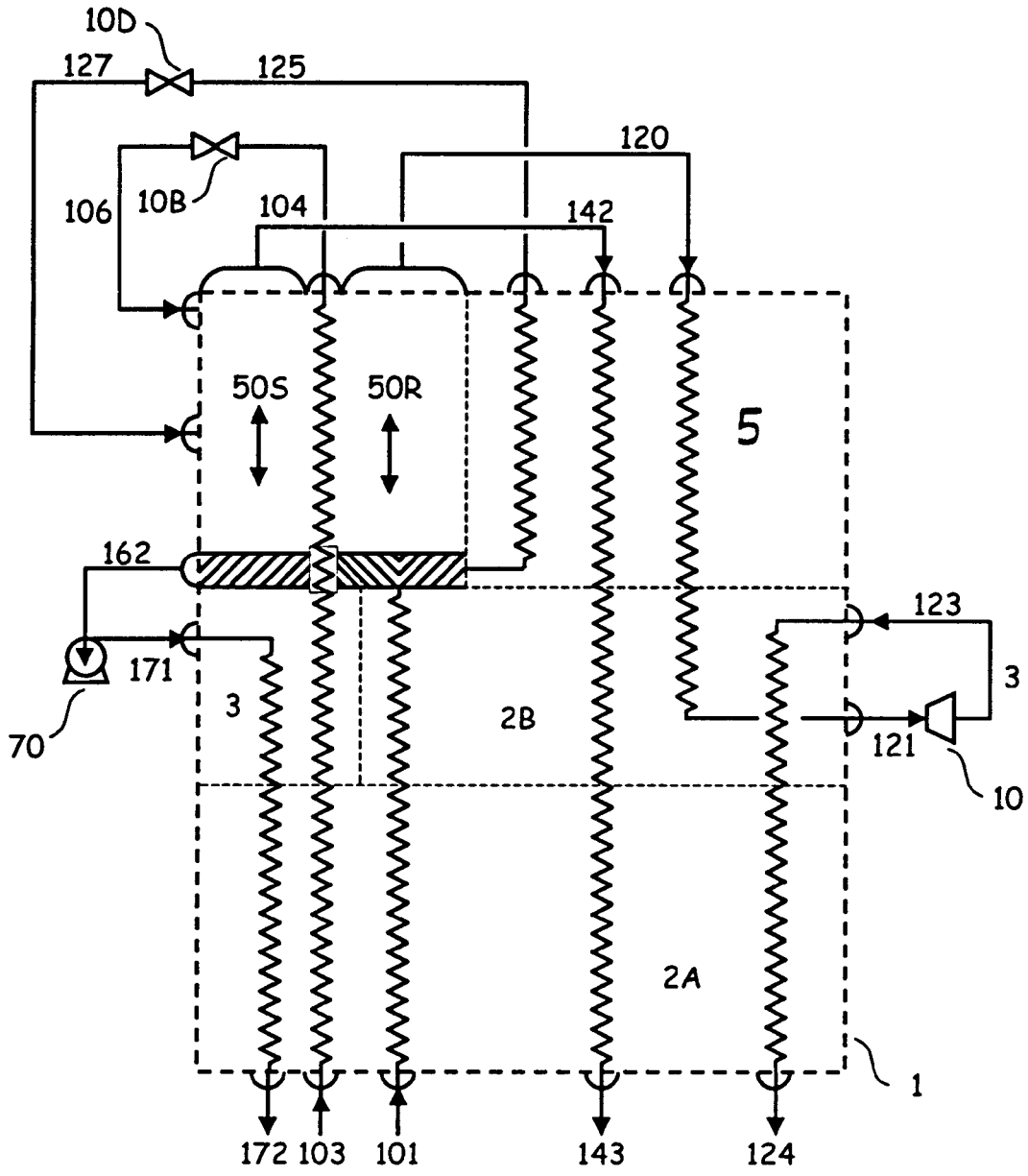
FIG. 4 shows an integrated core similar to that shown in FIG. 3, but with a heavy component liquid pumping unit.

FIG. 4 shows yet another embodiment of the present invention. Specifically, FIG. 4 shows a cryogenic air separation apparatus that includes a brazed core heat exchanger with a reflux condenser embedded therein. The apparatus of this embodiment incorporates a pump for pumping the heavy component-rich stream in order to deliver a higher pressure end product, typically pressurized $O_2$.

The overall process is similar to that of FIG. 1. Integrated core 1 in this embodiment, however, also receives higher pressure feed air stream 103 (in addition to lower pressure feed air stream 101, which is typically in the range of about 30 to about 55 psia). Both stream 103 (typically having a pressure in the range of about 250 to 800 psia) and stream 101 may be fed through passages in heat transfer sections 2A and 2B in a heat exchange relationship with other streams (exiting waste stream 143, product stream 124, and product stream 172, in this case), in order to be cooled to about 80 to 100K. In section 3 of integrated core 1, higher pressure air stream 103 may be condensed against liquid stream 171 exiting from product pump 70. Higher pressure air stream 103 then may be throttled in valve 10B and distributed into the cold end of stripping section 50S, which is least concentrated in a heavy component (oxygen in this case). In stripping section 50S higher pressure air stream 103 may be fractionated.

Feed air stream 101 is directed into rectification section 50R, which may serve as a non-adiabatic rectification column, as described above. Vapor stream 120 exits from rectification section 50R, and is preferably enriched in a light component to a purity of about 99%. Vapor stream 120 may be indirectly heated against liquid stream 125 in heat transfer section 5 of integrated core 1, and against incoming feed air stream 101 along the length of heat transfer section 2B to a temperature of about 85 to 100K. Stream 120 then may be fed, as stream 121, into turboexpander 10, which is shown here as being positioned outside of integrated core 1. Expander 10 may be used to expand stream 121 to provide plant refrigeration. Expanded stream 123, exiting turboexpander 10, enters section 2B and section 2A of integrated core 1, where it may be warmed to ambient temperature against other streams in integrated core 1, such as incoming streams 101 and 103, in this case. Stream 123 then exits integrated core 1 as vapor stream 124.

Liquid stream 125 exits rectification section 50R and then may be subcooled against other streams in heat transfer section 5 in a manner similar to that described with respect to the apparatus in FIG. 3. Stream 125 then may be throttled in valve 10D and distributed, as stream 127, into an intermediate level of stripping section 50S, as compared to the point of entrance of stream 106. Preferably, stripping section 50S further enriches liquid stream 127 in the heavy component (oxygen) to a purity of at least 45%.

Liquid stream 162 (typically a heavy component product) exits the bottom of stripping section 50S. Stream 162 may be pumped by pump 70 to produce product stream 171 at the pressure desired for distribution or consumption.

The remaining features of integrated core 1 of this embodiment are similar to those of the apparatus depicted in FIG. 1, although in an inverted orientation, and will not be repeated herein. It should be noted, however, that the apparatus in FIG. 4 may be modified so that its orientation matches that of the apparatus shown in FIG. 1.

Figure 5:
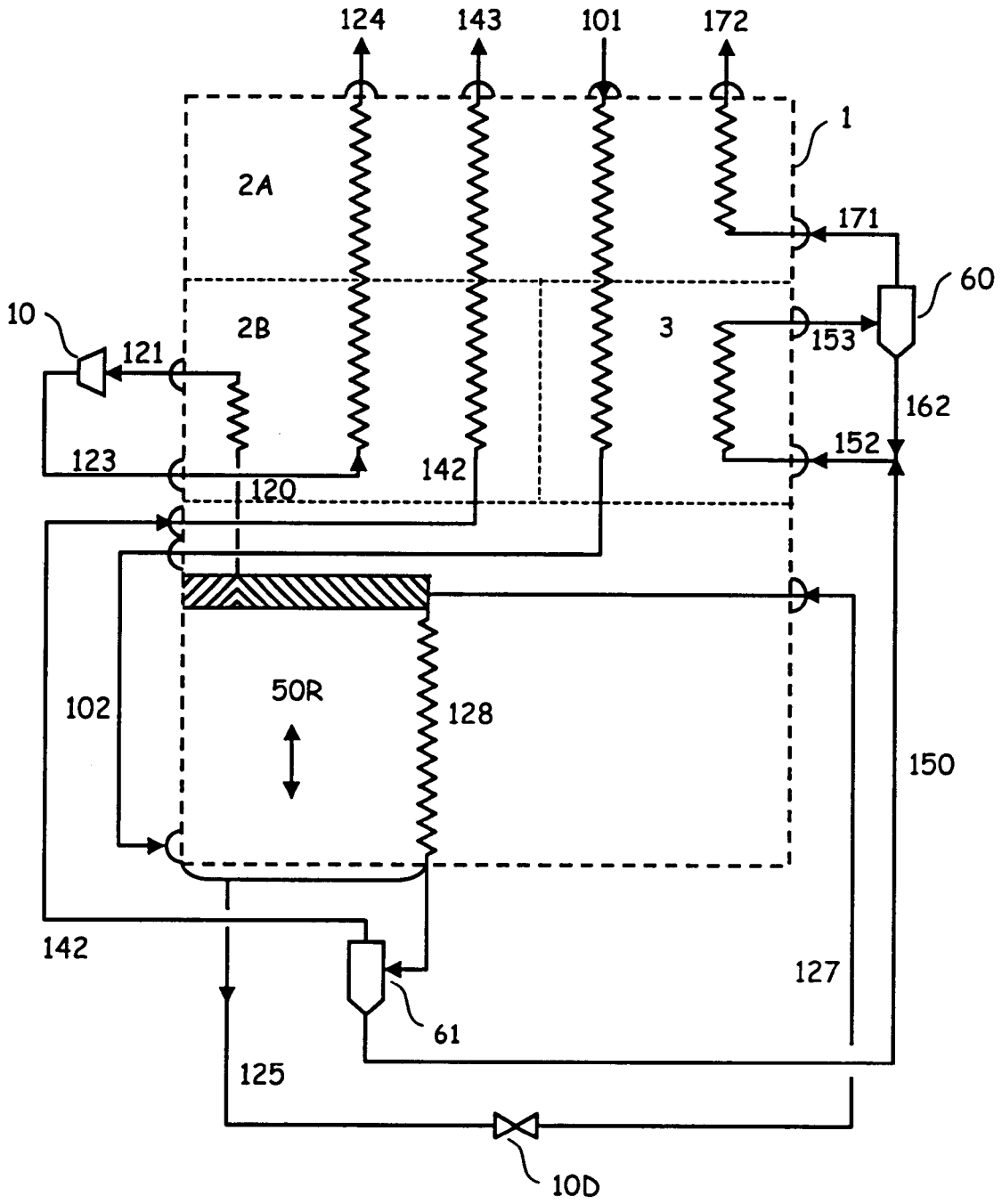
FIG. 5 shows an integrated core according to another embodiment of the present invention in which a reflux condenser is embedded in the integrated core without separation on the boiling side.

FIG. 5 depicts a cryogenic air separation apparatus similar to that shown in FIG. 1, but which does not utilize separation on the boiling side of integrated core 1. Specifically, the apparatus shown in FIG. 5 does not include stripping section 50S. Thus, integrated core 1 includes only a one-stage mass transfer process.

Instead of entering stripping section 50S, throttled stream 127 may be boiled along a passage which is preferably in a heat exchange relationship with rectification section 50R. Stream 128 is concurrently evaporated as it descends through the passages thereby supplying refrigeration to condense the fluid on the rectification side 50R. The resulting two-phase effluent stream is separated in separator 61 into liquid stream 150 and vapor stream 142.

Vapor fraction stream 142 may be warmed against incoming feed air stream 101 in section 2 and then leaves integrated core 1 as stream 143. Liquid fraction stream 150 is combined with liquid stream 162 from separator 60 and passed through heat exchanger section 3 where it is partially vaporized as previously shown in FIG. 1. The remainder of the features of this embodiment is similar to that described with respect to FIG. 1.

Figure 6:
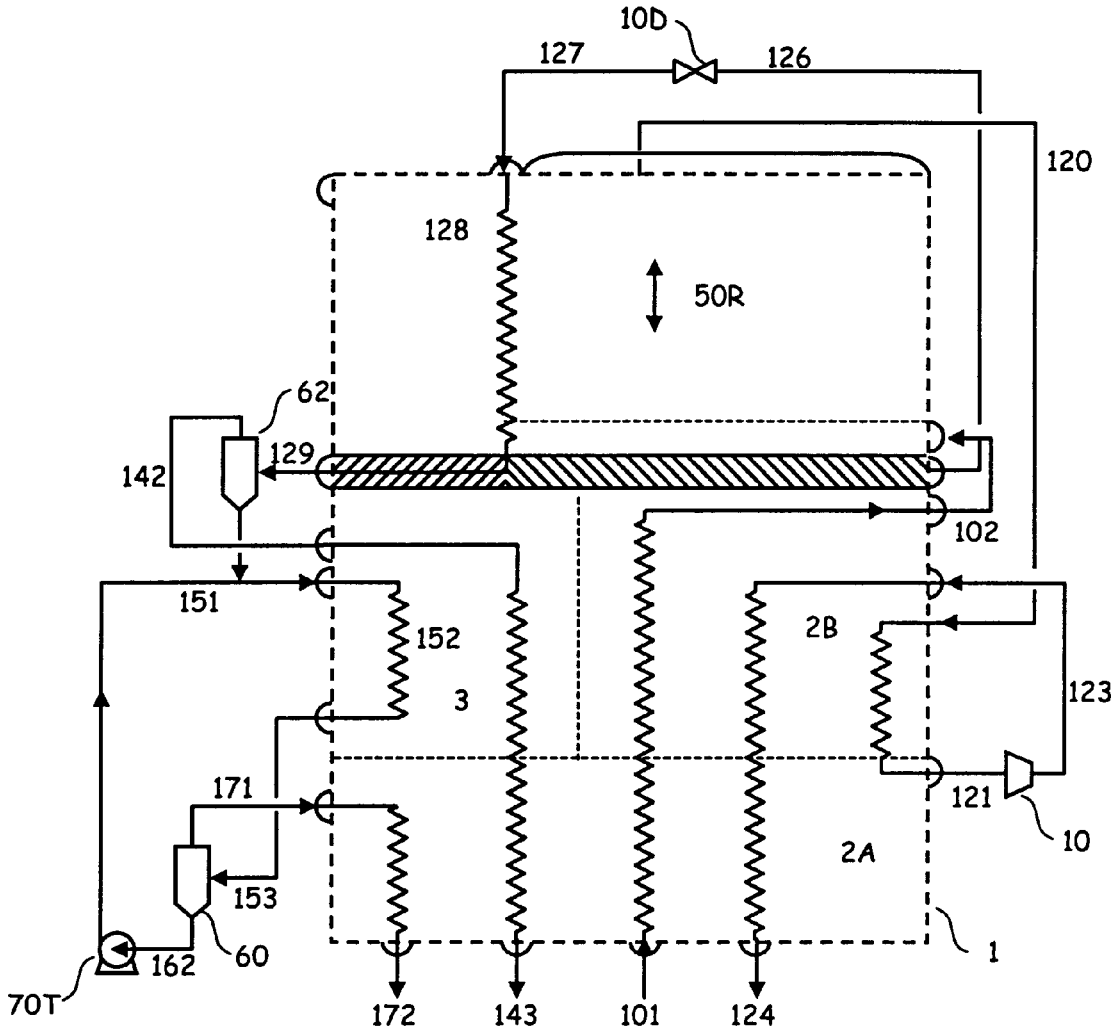
FIG. 6 shows an integrated core similar to that shown in FIG. 5, but with a reverse orientation.

FIG. 6 shows an apparatus similar to that shown in FIG. 5; however, the integrated core shown in FIG. 6 is inverted when compared to the integrated core shown in FIG. 5. Accordingly, the apparatus in FIG. 6 includes pump 70T, as described above with respect to FIG. 2.

Figure 7:
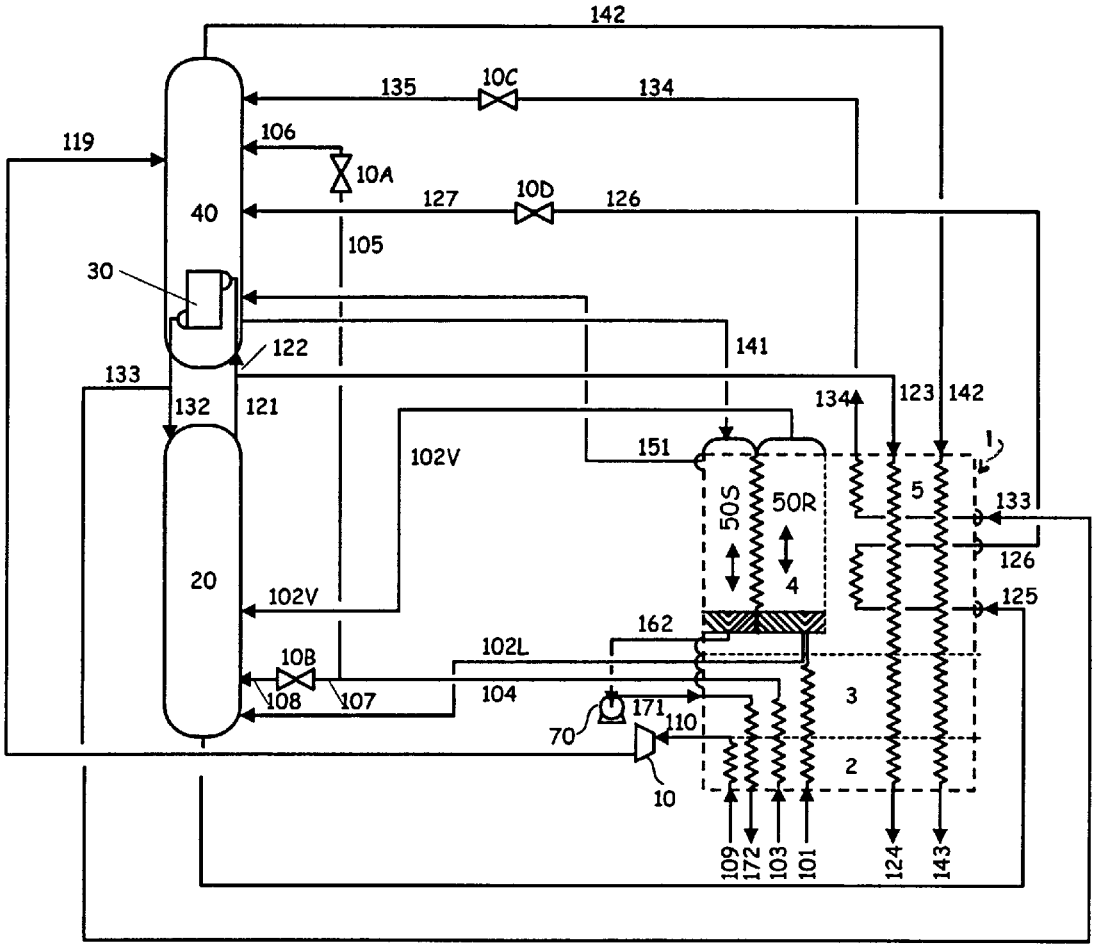
FIG. 7 shows a separation system according to another embodiment of the present invention, which includes a side stripping column for producing a low purity heavy component product.

FIG. 7 shows a cryogenic air separation system including an integrated core similar to those shown in FIGS. 1, 3 and 4. The air separation system utilizes a double-column air separation apparatus in conjunction with the integrated core to produce a low purity heavy component stream. The double-column system includes a higher pressure column 20 and a lower pressure column 40, both of which are in flow communication with each other and integrated core 1. In integrated core 1, prepurified low pressure air stream 101, high pressure boosted air stream 103, and intermediate pressure turbine air stream 109 may be cooled against exiting stream 143 (typically light component waste, e.g., nitrogen), stream 172 (typically a heavy component product, e.g. oxygen), and stream 124 (typically a light component product, e.g., nitrogen) in heat transfer sections 2 and 3. This takes place at the warm end of the integrated core 1.

Intermediate pressure air stream 109 (typically about 125 to about 200 psia, and including about 7 to about 15% of the total feed air flow) may exit integrated core 1 as cooled air stream 110. Preferably, stream 110 exits integrated core 1 once it reaches a temperature in the range of about 140 to about 160K. Stream 110 may be expanded in turboexpander 10 to provide plant refrigeration to compensate for the various sources of refrigeration loss and heat leakage in the process. The resulting expanded turbine air stream 119 (typically about 19 to about 22 psia) is fed into lower pressure separation column 40.

Feed air stream 101 and higher pressure air stream 103 continue through integrated core 1, where they may be further cooled. Higher pressure air stream 103 (typically about 100 to about 450 psia, and about 25 to about 35% of the total feed air flow) may be condensed against stream 171 (which is typically a heavy component stream) along heat transfer section 3 of integrated core 1. Air stream 103 may be in a direct crossflow orientation with stream 171. The resulting subcooled liquid boosted air stream 103 exits integrated core 1 as stream 104 (preferably once it reaches a temperature in the range of about 95 to about 115K).

In this embodiment, liquid air stream 104 is split into streams 105 and 107. Air stream 105 may be throttled in valve 10A and fed, as stream 106, into lower pressure rectification column 40. Stream 106 may include up to 100 percent of the total subcooled liquid. Stream 107 may be throttled in valve 10B and fed, as stream 108, into higher pressure rectification column 20.

Feed air stream 101 (which may have a pressure in the range of about 45 to about 60 psia) is fed into rectification section 50R (preferably after reaching a temperature of about 85 to 100K) at the cold end of integrated core 1, where it may undergo mass transfer while being condensed as a result of heat exchange with stripping section 50S. Liquid stream 102L (typically a heavy component-rich stream having a purity of about 40 mole percent oxygen) may exit rectification section 50R and integrated core 1 to be fed into the bottom of higher pressure rectification column 20. Vapor stream 102V (typically a light component-rich stream having a purity of about 90 mole percent nitrogen) may exit rectification section 50R and integrated core 1 to be fed into higher pressure rectification column 20 at an intermediate point. Higher pressure rectification column 20 may further fractionate streams 102V, 102L and liquid feed air stream 108, into almost pure light component vapor overhead stream 121 (nitrogen in this case) and heavy component-rich bottom liquid stream 125 (oxygen in this case, which may have a purity of about 40%). A small fraction of overhead stream 121 (typically up to about 10%) may be taken as product stream 123. Stream 123 enters the cold end of integrated core 1 where it may be warmed to ambient temperature against any of streams 101, 103, 109, 125 and 133 before exiting integrated core 1 as stream 124.

The remaining portion of overhead stream 121 may be fed into lower pressure rectification column 40 to be condensed in main condenser 30 against the bottom, heavy component-rich liquid of lower pressure column 40 (oxygen in this case). The condensate from main condenser 30 is withdrawn and split into streams 132 and 133. Stream 132 typically includes about 40 to about 55% of the overhead stream 121, and may be returned to the top of higher pressure column 20 for reflux. Stream 133 may be fed into integrated core 1 at heat transfer section 5. In heat transfer section 5, stream 133 may be cooled against exiting streams, such as streams 142 and 123. Stream 125 is subcooled in section 5 and exits core 1 as stream 126, where it may be throttled in valve 10D. Resulting stream 127 may be fed into lower pressure separation column 40. Stream 133 is likewise subcooled in section 5 and exits core 1 as stream 134, which may be throttled in valve 10C and fed into lower pressure column 40 as stream 135. Liquid streams 135 and 127 may be further fractionated in lower pressure separation column 40.

Overhead stream 142 (light component vapor in this case, e.g., nitrogen, having a purity of about in excess of 99 mole percent) exits the top of lower pressure separation column 40. Liquid stream 141 (having a heavy component purity of about 90%) exits the bottom of lower pressure separation column 40. Bottom liquid stream 141 is fed into stripping section 50S of integrated core 1. Stripping section 50S, as described in detail above, preferably serves as a reboiled stripping separation column. The reboiling in section 50S may be provided through a thermal link with another passage of integrated core 1, such as rectification section 50R in this case. Vapor stream 151 exits at the top of stripping section 50S to be returned to lower pressure separation column 40. Bottom liquid oxygen stream 162 exits from section 50S as a heavy component product (oxygen in this case) having a purity in the range of 98 to 99.9 mole percent. Liquid stream 162 may be pressurized using pump 70, outside of core 1. Resulting pressurized liquid oxygen stream 171 is fed into integrated core 1 at heat transfer section 3. The pressure developed by pump 70 is determined by the product requirements. Liquid stream 171 may be vaporized against an air stream of integrated core 1, for instance, boosted air stream 103, and warmed to ambient temperature against any of incoming air streams 101, 103 and 109, along with the other exit streams 123 and 142. Resulting air stream 172 exits integrated core 1 at ambient temperature.

Figure 8:
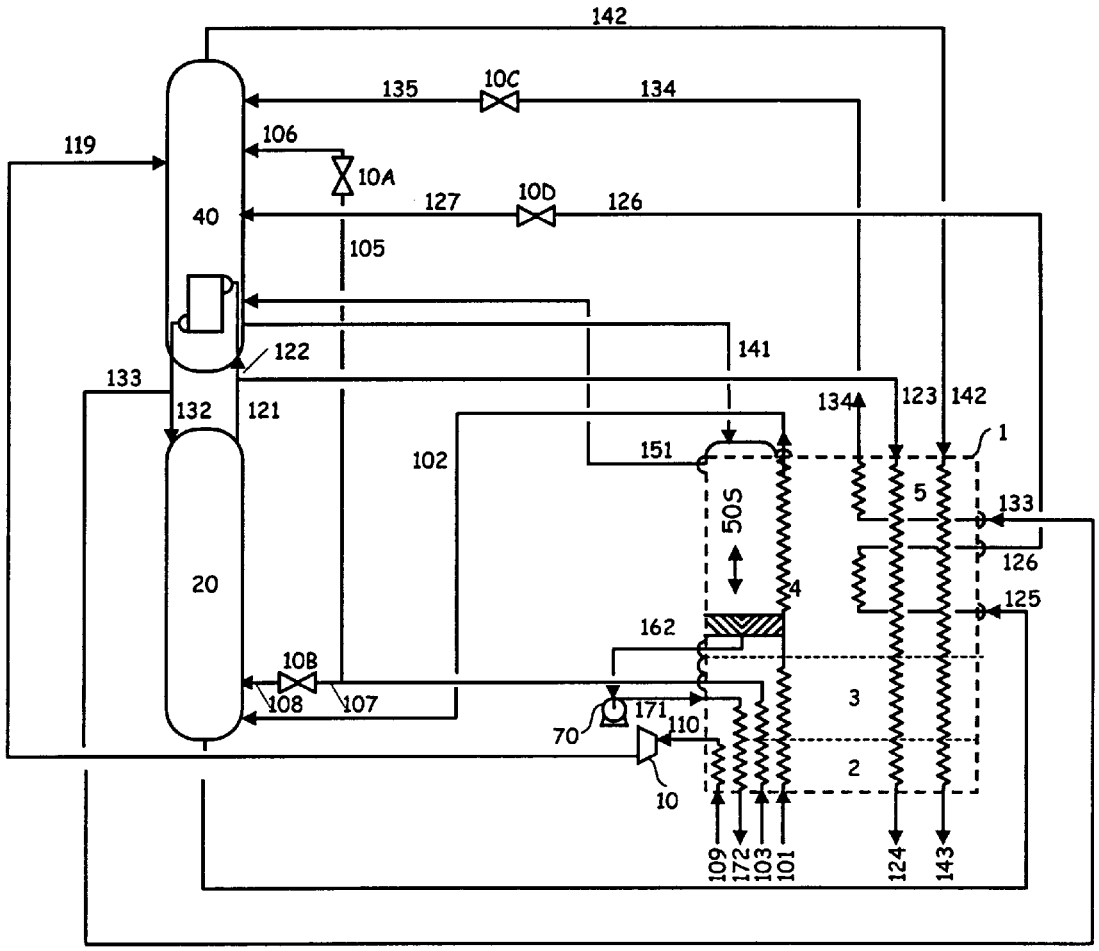
FIG. 8 shows a separation system similar to that shown in FIG. 7, but without separation on the condensing side.

FIG. 8 shows a cryogenic air separation system similar to that shown in FIG. 7. However, the system shown in FIG. 8 does not utilize mass transfer on a condensing side. Thus, there is no overhead vapor stream 102V or bottom liquid stream 102L produced in a rectification section 50R. Instead, a single two-phase stream 102 may be partially condensed in heat transfer section 4 of integrated core 1 against the stripping section 50S and then fed into higher pressure rectification column 20.

Although not depicted, integrated core 1 may be designed so that only a small portion (about 0.2 to about 0.3%) of feed air stream 101 is fed through heat transfer section 4. The resulting air stream exiting heat transfer section 4 could be totally condensed. The condensed air stream could be fed into either of the separation columns, as deemed necessary. The remaining portion of feed air stream 101 would be fed into higher pressure separation column 20 to be separated in a manner similar to that described above with respect to the apparatus shown in FIG. 7.

The embodiments depicted in the figures are exemplary and thus, do not convey all of the possible variations of the present invention. For instance, the separation sections and heat transfer sections may serve different mass transfer and heat exchange functions, depending on the needs of a particular plant design. In addition, sections may be incorporated in the plate-fin core for superheating exiting fluids against pre-throttled heavy component-rich liquids. The particular internal configuration of the integrated core may also be varied to optimize particular applications. Thus, fin types, passage arrangements, flow directions, and the use of cross flows may be substituted as necessary. Also, the streams from different integrated separation sections may be drawn as either liquid or vapor with slight adjustments to the design of the integrated core. Different methods for providing refrigeration may also be incorporated into the system, e.g., lower column feed air expansion, upper column feed air expansion, liquid addition, and mixed gas refrigeration, etc. Also, although the above discussed embodiments focus on cryogenic air separation, this invention may be applied to generic separation processes in various heat transfer networks.

We claim:

1. A heat-transfer and mass-transfer integrated core comprising:

an entrance passage cooling an incoming feed air stream;

a rectification section comprising at least one passage facilitating mass transfer of the feed air stream to produce a first liquid stream enriched in a heavy component and a first vapor stream enriched in a light component;

a first exit passage in a heat exchange relationship with said entrance passage, said first exit passage warming the first vapor stream and discharging the first vapor stream from said integrated core;

a separation section comprising at least one passage in a heat exchange relationship with the at least one passage of said rectification section, said separation section facilitating separation of the first liquid stream into a second liquid stream and a second vapor stream;

a second exit passage, in a heat exchange relationship with said entrance passage, warming and discharging the second vapor stream from said integrated core; and a vaporization section comprising at least one passage in a heat exchange relationship with said entrance passage, said vaporization section vaporizing the second liquid stream, and discharging the vaporized second liquid stream from said integrated core.

2. The integrated core according to claim 1, wherein said at least one passage of said separation section is a stripping passage using countercurrent flow to strip the first liquid stream to produce the second liquid stream, enriched in a heavy component, and the second vapor stream, enriched in a light component.

3. The integrated core according to claim 1, wherein said at least one passage of said separation section boils the first liquid stream to form the second liquid stream and the second vapor stream.

4. The integrated core according to claim 1, wherein said integrated core is orientated such that the feed air stream enters said entrance passage in a downward direction of flow, and said first exit passage, said second exit passage, and said vaporization passage discharge vapor from said integrated core in an upward direction of flow.

5. The integrated core according to claim 1, further comprising a warmer end and a cooler end, said rectification section and said separating section being positioned in said cooler end, said entrance passage receiving the incoming feed air at said warmer end, and said first exit passage, said second exit passage and said vaporization passage discharging streams at said warmer end.

6. An air separation system comprising:

(i) the integrated heat exchange core according to claim 1, wherein said vaporization section comprises a first vaporizing passage and a second vaporizing passage; and (ii) a phase separator in flow communication with said vaporization section of said integrated core, said phase separator receiving the partially vaporized second liquid stream from said first vaporizing passage, separating the second liquid stream into a third liquid stream and a third vapor stream, and feeding the third liquid stream to said first vaporizing passage and the third vapor stream to said second vaporizing passage.

7. A cryogenic air separation system comprising:

a double column separation system for fractionating air streams, said double column separation system comprising:

(i) a lower pressure column; and (ii) a higher pressure column in flow communication with said lower pressure column; and an integrated heat exchange core in flow communication with said double column system, said integrated core comprising:

(i) a first intake passage for cooling a first feed air stream, said first intake passage having a warmer section and a cooler section, said cooler section feeding a cooled vapor stream to said higher pressure column;

(ii) a stripping section comprising at least one passage in a heat exchange relationship with said cooler section of said first intake passage, said stripping section stripping a bottom liquid stream from said lower pressure column to form a first liquid stream, enriched in a heavy component, and a first vapor stream, enriched in a light component, said at least one passage of said stripping section feeding the first vapor stream into said lower pressure column;

(iii) a first exit passage in a heat exchange relationship with said first intake passage, said first exit passage vaporizing and discharging the first liquid stream;

(iv) a second exit passage in a heat exchange relationship with said first intake passage, said second exit passage warming and discharging a first top vapor stream received from said higher pressure column; and (v) a third exit passage in a heat exchange relationship with said first entrance passage, said third exit passage discharging a second top vapor stream received from said lower pressure column.

8. A method of separating air in an integrated heat exchange core, said method comprising the steps of:

cooling an incoming feed air stream against at least one exiting stream:

rectifying the incoming feed air to form a first liquid stream enriched in a heavy component and a first vapor stream enriched in a light component;

discharging the first vapor stream from the integrated core while warming the first vapor stream against the incoming feed air stream;

feeding the first liquid stream through the integrated core in a heat exchange relationship with the rectification section so as to separate the first liquid stream into a second liquid stream and a second vapor stream;

discharging the second vapor stream from the integrated core while warming the second vapor stream against the first incoming feed air stream;

vaporizing the second liquid stream in a heat exchange relationship with the incoming feed air stream; and discharging the second liquid stream vaporized in said vaporizing step from the integrated core.

9. An air separation method comprising the steps of:

cooling a first feed air stream along an intake passage having a warmer end and a cooler end in an integrated core;

feeding the first cooled vapor stream into a higher pressure column of a double column separation system;

stripping a bottom liquid received in the integrated core from a lower pressure column of the double column separation system along a passage in a heat exchange relationship with the first feed air stream, to form a first liquid stream, enriched in a heavy component, and a first vapor stream, enriched in a light component;

feeding the first vapor stream into the lower pressure column;

vaporizing the first liquid stream formed in said stripping step along a passage in a heat exchange relationship with the first feed air stream in the integrated core;

warming a first top vapor stream received from the higher pressure column along at least one passage of the integrated core;

discharging the warmed first top vapor stream from the integrated core;

warming a second top vapor stream received from the lower pressure column of the double column separation system along at least one passage of the integrated core; and discharging the warmed second top vapor stream from the integrated core.

10. The method according to claim 9, further comprising the steps of rectifying the feed air stream into a second liquid stream, enriched in a heavy component, and the cooled vapor stream, enriched in a light component, along at least one passage of the integrated core, and feeding the cooled second vapor stream into the higher pressure column in said step of feeding the cooled vapor stream into the higher pressure column.

* * * * *